US006518923B2

(12) United States Patent
Barquist et al.

(10) Patent No.: US 6,518,923 B2
(45) Date of Patent: Feb. 11, 2003

(54) METHOD AND APPARATUS FOR TRANSMITTING SIGNALS VIA AN ACTIVE SAMPLER ANTENNA

(75) Inventors: William Sven Barquist, Lakeport, CA (US); William Walter Anderson, Half Moon Bay, CA (US); George Allan Whittaker, Alpharetta, GA (US); Thomas John Rohrer, Marietta, GA (US); John Jesse Soderberg, Acworth, GA (US); John McGinnis, Acworth, GA (US); Michael Gregory Abernathy, Ellijay, GA (US)

(73) Assignee: Lockheed Martin Corporation, Bethesda, MD (US)

( * ) Notice: Subject to any disclaimer, the term of this patent is extended or adjusted under 35 U.S.C. 154(b) by 36 days.

(21) Appl. No.: 09/894,255

(22) Filed: Jun. 28, 2001

(65) Prior Publication Data

US 2003/0001791 A1 Jan. 2, 2003

(51) Int. Cl.[7] ..... H01Q 1/36
(52) U.S. Cl. ..... 343/700 MS

(58) Field of Search ..... 343/700 MS, 853, 343/772; 359/237, 254; 385/40

(56) References Cited

U.S. PATENT DOCUMENTS 4,379,296 A * 4/1983 Farrar et al. ..... 343/700 MS

* cited by examiner

*Primary Examiner*—Michael C. Wimer
(74) *Attorney, Agent, or Firm*—Bracewell & Patterson, L.L.P.

(57) ABSTRACT

An active sampler antenna capable of transmitting signals is disclosed. The active sampler antenna includes a first set of conducting surfaces, a second set of conducting surfaces, a power source, and multiple switches. The second set of conducting surfaces is located substantially parallel to the first set of conducting surfaces. The power source has two terminals, namely, a first terminal and a second terminal. The first terminal of the power source is connected to the second set of conducting surfaces. Each of the switches is connected between a respective one of the first set of conducting surfaces and the second terminal of the power source. The switches allows a defined amount and timing of charges to be delivered from the power source to the first set of conducting surface for signal transmissions.

27 Claims, 4 Drawing Sheets

METHOD AND APPARATUS FOR TRANSMITTING SIGNALS VIA AN ACTIVE SAMPLER ANTENNA

REFERENCE TO A RELATED PATENT

The present application is related to U.S. Pat. No. 6,252,557 entitled "PHOTONICS SENSOR ARRAY FOR WIDEBAND RECEPTION AND PROCESSING OF ELECTROMAGNETIC SIGNALS," the pertinent portion of which is incorporated herein by reference.

BACKGROUND OF THE INVENTION

1. Technical Field

The present invention relates to antennae in general, and in particular to electro-optical antennae. Still more particularly, the present invention relates to an active sampler antenna for transmitting signals.

2. Description of the Prior Art

Antenna arrays for receiving and transmitting electromagnetic signals are well-known in the art. Generally speaking, traditional antenna arrays have a relatively narrow operational bandwidth. Further, the size of traditional antennae tend to be relatively large because antenna elements within traditional antenna arrays require some form of transmission lines, such as coaxial cables, microstrips, or striplines, to connect to each other. In addition, as the desired operational frequency increases, the backplane complexity of traditional antennae also increases, not to mention substantial signal losses also incur on the transmission lines of the traditional antennae. Antenna radiating elements are limited in bandwidth typically by reactive circuit elements at onset of undesired propagation and radiating modes.

Spiral antenna elements can be used to increase the bandwidth of a traditional antenna. However, the size of spiral antenna elements increases as the desired operational frequency decreases. Also, the spacing within spiral antenna elements tends to be relatively large, and the large spacing has an adverse effect on the operation of the entire antenna array. Although electrically small antennae can be used to overcome the above-mentioned spacing problem, the efficiency of such antennae is typically very poor or many small antennae are required in highly reactive arrays.

An electro-optic antenna is capable of better wideband receptions than traditional antennae. The present disclosure provides an improved method and apparatus for transmitting signals via an electro-optic antenna.

SUMMARY OF THE INVENTION

In accordance with a preferred embodiment of the present invention, an active sampler antenna includes a first set of conducting surfaces, a second set of conducting surfaces, a power source, and multiple switches. The second set of conducting surfaces is located substantially parallel to the first set of conducting surfaces. The power source has two terminals, namely, a first terminal and a second terminal. The first terminal of the power source is connected to the second set of conducting surfaces. Each of the switches is connected between a respective one of the first set of conducting surfaces and the second terminal of the power source. The switches allows a defined amount and timing of charges to be delivered from the power source to the first set of conducting surface for signal transmissions.

All objects, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

A sampler antenna is an aperture structure for receiving and/or transmitting wideband radio frequency (RF) signals preferably at 20 MHz to 20 GHz. The receiving and transmitting frequencies can potentially be scaleable from 2 MHz to 200 GHz. A sampler antenna includes multiple integrated photonic devices called Mach-Zehnder modulators as antenna elements. Each Mach-Zehnder modulator is called a sampler because it is configured to measure periodic spatial samples of the surface current induced by an incoming electromagnetic wave. A Mach-Zehnder modulator detects surface currents through the coupling capacitance and complex fringing fields within gaps cut across metallic strips, i.e., through the voltages within the gaps between conducting squares of an non-resonant array of squares. The antenna elements are a fraction of a wavelength (at the highest frequency of interest) in dimension and are arranged in an array to provide aperture necessary to meet system sensitivity requirements.

Figure 1:
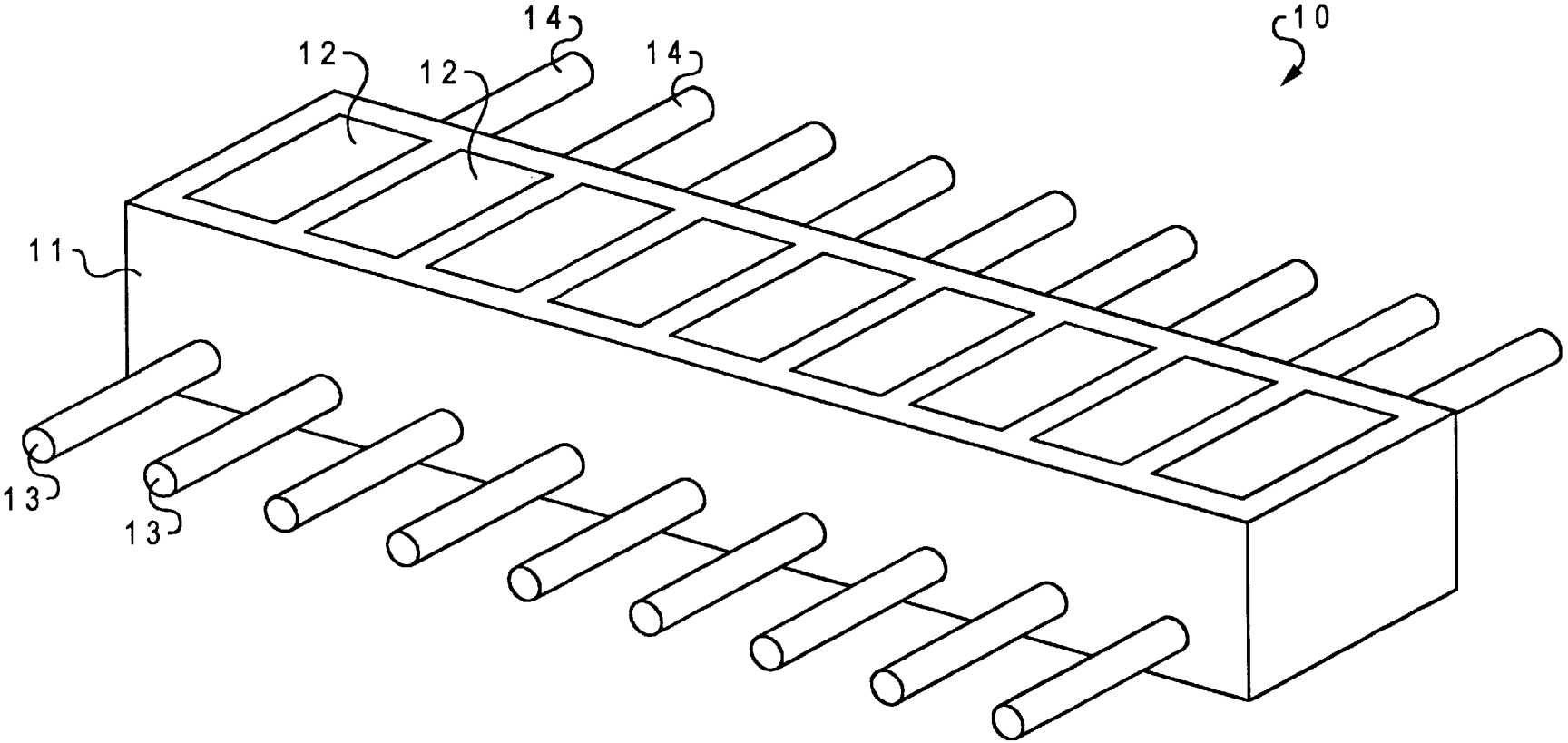
FIG. 1 is a pictorial depiction of a sampler antenna in a linear array, in accordance with a preferred embodiment of the present invention.

Referring now to the drawings and in particular to FIG. 1, there is illustrated a pictorial depiction of a sampler antenna 10, in accordance with a to preferred embodiment of the present invention. Sampler antenna 10 includes a dielectric support 11, antenna elements 12, input optical fibers 13, and output optical fibers 14. Antenna elements 12 (also referred to as "radiators") are metallic strips or planar electrodes printed on a polymer sheet. Sampler antenna 10 also includes several Mach-Zehnder modulators (not shown), each centered underneath the gap between two adjacent antenna elements 12. Each Mach-Zehnder modulator is stimulated by an optical source, preferably a laser, via one of input optical fibers 13. An electromagnetic wavefront, which impinges upon sampler antenna 10, can generate an electric field across sampler antenna 10. The electric field in turn sets up a voltage across each gap between two adjacent antenna elements 12 as well as between each of antenna elements 12 and its corresponding coupling strip. The voltage modulates an optical drive signal provided by input optical fibers 13. Output optical fibers 14 are fed to a photodiode or other suitable optical detector where optical signals may be recovered according to conventional methods that are well-known in the art. The above-mentioned condition is repeated across the entire sampler antenna 10 to effectively sample any electromagnetic wavefront that can be reconstructed. By keeping the size of antenna elements 12 small, the response bandwidth of sampler antenna 10 can be made very large.

Figure 2:
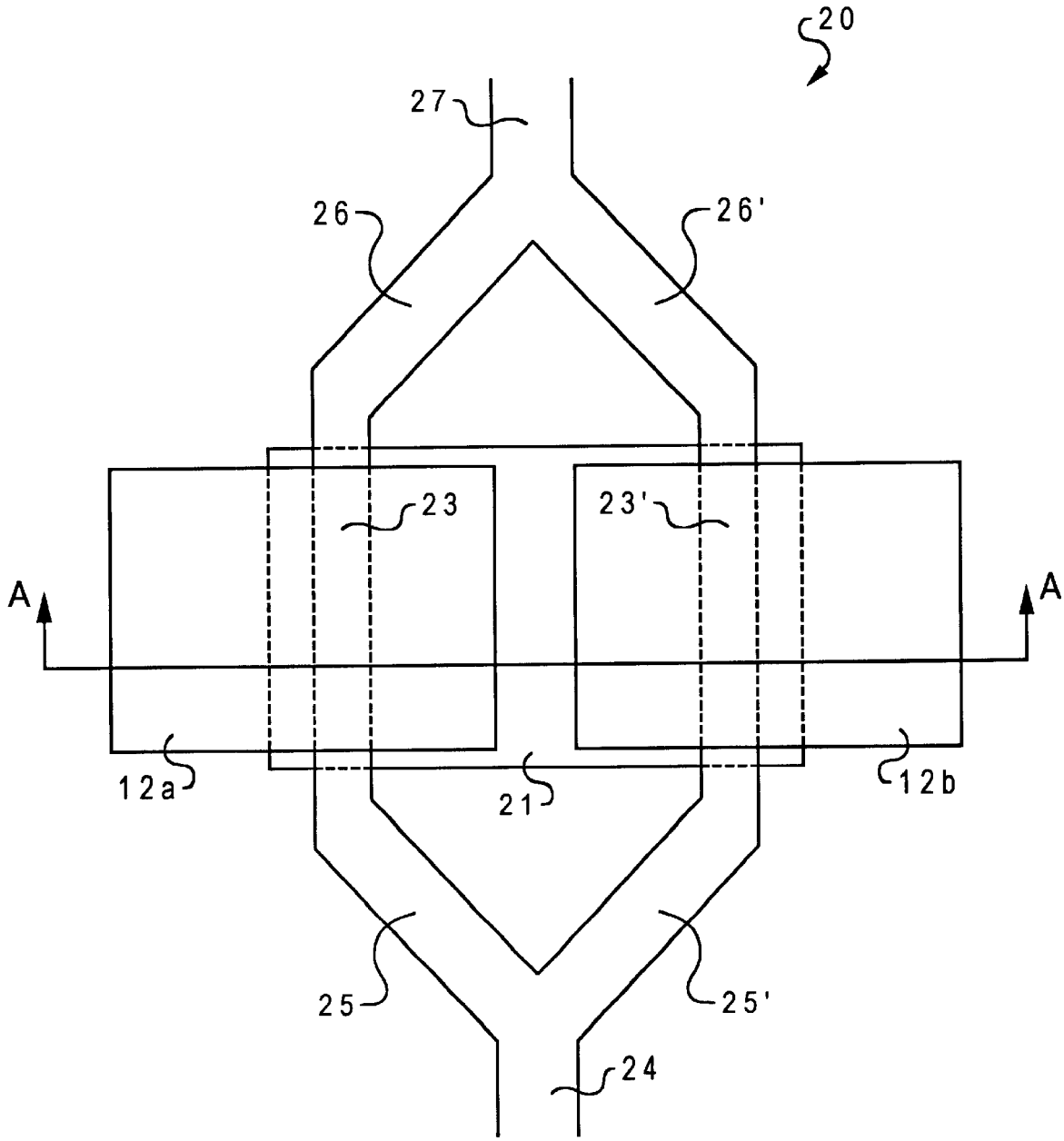
FIG. 2 is a top view of a sampler cell of the sampler antenna from FIG. 1, in accordance with a preferred embodiment of the present invention.

With reference now to FIG. 2, there is illustrated a top view of a single sampler cell of sampler antenna 10, in accordance with a preferred embodiment of the present invention. As shown, a sampler cell 20 (i.e., a Mach-Zehnder modulator) includes two conducting plates 12*a*, 12*b*, two optical waveguides 23, 23' and a conducting plate 21. Optical waveguides 23, 23' lie between conducting plates 12*a*, 12*b*, respectively, and conducting plate 21 effectively form a pair of capacitors. One of conducting plates 12*a* and 12*b* are held to the same potential as conducting plate 21. Specifically, one of conducting plates 12*a*, 12*b* is electrically connected to conducting plate 21, while the other antenna element is connected to a direct current (DC) bias for biasing sampler cell 20 at its quadrature point or any point that is desired.

Sampler cell 20 also includes an optical input channel 24 that receives an optical drive signal provided by an input optical fiber such as input optical fiber 13 from FIG. 1. Optical input channel 24 is split into two optical paths 25 and 25'. Optical signals pass beneath conducting plates 12*a* and 12*b* via optical channels 23 and 23', respectively. If conducting plate 12*b* is electrically tied to conducting plate 21, the impinging RF fields surface currents that creates voltage gradients on conducting plates 12*a*, 12*b* will then induce varying surface currents that generate voltage gradients between the "floating" conducting plate 12*a* and conducting plate 21. Such voltage can advance or retard the optical signal in intervening optical path 23, changing its phase relative to "tied" optical path 23'. The optical signals exiting sampler cell 20 via paths 26 and 26' are then combined to produce a modulated output signal at an optical output channel 27. Optical output channel 27 is connected to an output optical fiber such as output optical fiber 14 from FIG. 1.

Figure 3:
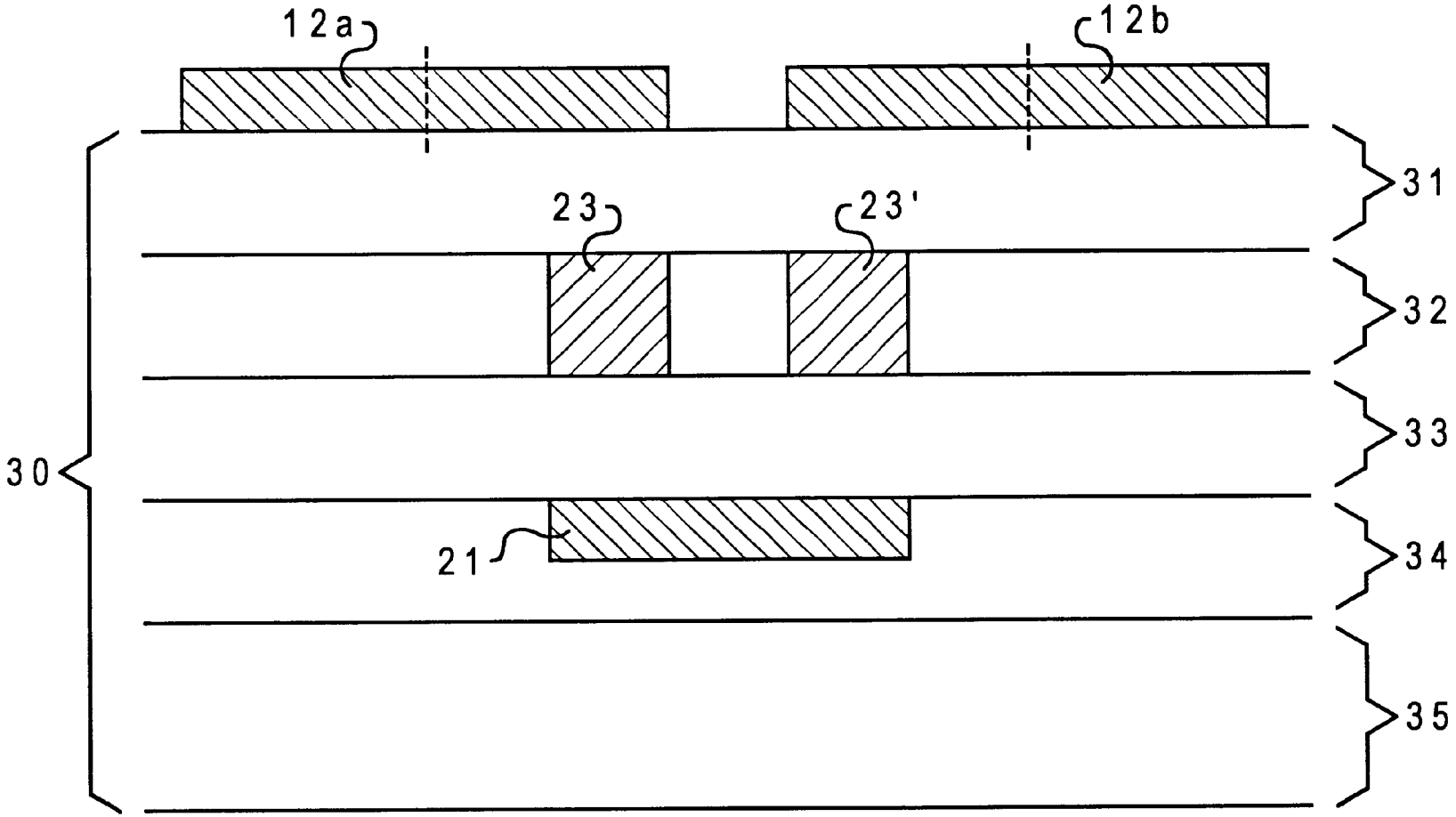
FIG. 3 is a cross-sectional illustration of the sampler cell from FIG. 2, in accordance with a preferred embodiment of the present invention.

Referring now to FIG. 3, there is depicted a cross-sectional illustration of sampler cell 20 along section A—A, in accordance with a preferred embodiment of the present invention. As shown, conducting plates 12*a* and 12*b* are mounted upon body 30. Body 30 includes polymer layers 31, 32, and 33. Each of polymer layers 31–33 is approximately three micrometers thick, and preferably has a dielectric constant of 3.4. Optical waveguides 23, 23' are formed within polymer layer 32. Polymer layer 33 adjoins a silicon dioxide ($SiO_2$) layer 34 having a thickness of 2.0 micrometers and a dielectric constant of 3.9. Polymer layers 31 and 33 effectively become the cladding. $SiO_2$ layer 34, which includes conducting plate 21, adjoins a silicon substrate 35 having a thickness of 10–20 mils, a dielectric constant of 12, and a resistivity of 3000 ohm-centimeters. In a preferred embodiment, the electro-optic polymer is a two component material having a 15% (by weight) of chromophore 4-(Dicyano-methylene)-2-methyl-6-(4-dimethylaminostyryl)-4H-pyran (DCM) in the partially-fluorinated polyimide polymer ULTRADEL 4212®, available from BP Amoco Chemicals Inc., Warrensville Heights, Ohio. Although the construction has been described using polymer materials, any suitable electro-optic material may be used to form body 30. Also, conducting plates 12*a*, 12*b* measure approximately one inch on each edge and are separated from each other by a gap measuring between 100 micrometers and 2 mils.

In accordance with a preferred embodiment of the present invention, each antenna element within an active sampler antenna is capacitively coupled to a switch for transmitting signals via the active sample antenna. Signal transmissions is synthesized by exciting a series of antenna elements in an appropriate polarity, sequence, and time duration to generate skin currents in a conducting surface that is capable of radiating RF energy. In other words, radiating waves are generated by depositing charges on a conducting surface of a set of conducting plates of an active sampler antenna according to an appropriate space-time sequence via a group of switches connected to the conducting plates; thus creating a surface current across the antenna structure. Specifically, charges are deposited on the radiating surfaces of the conducting plates by space-time distributed charge coupled packets.

Since both polarities of direct current are required for charge inducement, the excitation of each element may be derived directly for a local alternating current (AC) or direct current (DC) power source (or power supply) with required controlled rectification and energy storage from cycle-to-cycle provided at each of the antenna elements. Surface currents required for the conversion of optical to RF power at the active sampler antenna is compatible with the supply voltages requirements for various lower power transmissions. Higher supply voltages can produce higher RF transmissions.

The controlled element excitation for transmission is managed through a photonically excited switch or transistor located at or adjacent to each antenna element. The photonic excitation (or control) of the photonically excited switches or transistors are preferably provided through data transmitted on an array of fiber optic cables. The digital information provided via the fiber optic cables also supports beam steering and the waveform generation processes. Beam steering can be computed using conventional calculation for delay taper across the sampler antenna with augmentation to compensate for both the static and dynamic antenna shapes. A convention faster than copper implemenation is required to control the photonically excited switches with sufficient samples per RF cycle to control the spurious emissions to the desired level, which may be as few as five samples per RF cycle.

Figure 4:
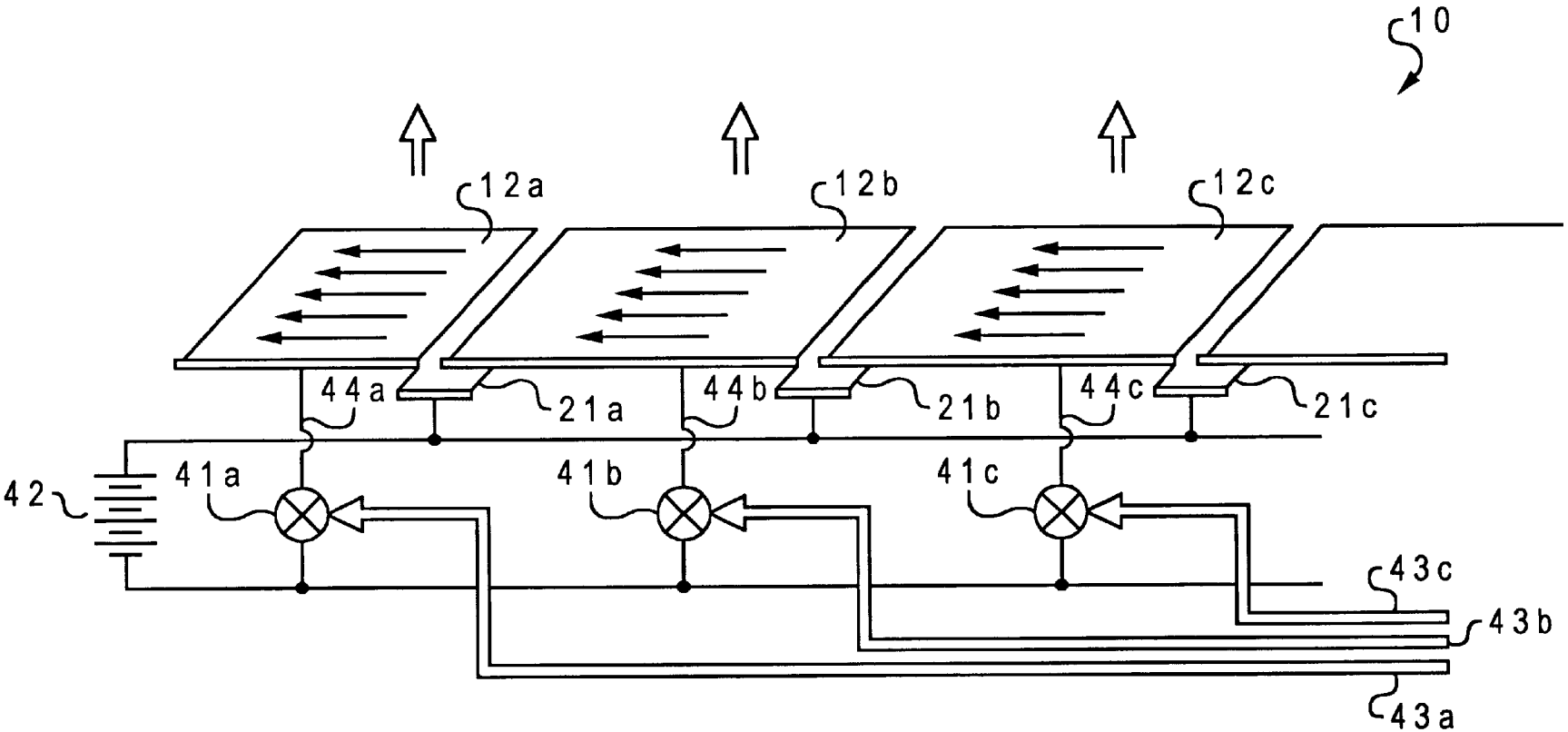
FIG. 4 is a pictorial diagram of an apparatus for transmitting signals via the sample antenna from FIG. 1, in accordance with a preferred embodiment of the present invention.

For example, as shown in FIG. 4, conducting plates 12*a*, 12*b*, and 12*c* are connected to switches 41*a*, 41*b*, and 41*c*, respectively. Switches 41*a*, 41*b*, and 41*c* may be photosensitive switches, semiconductor switches, such as transistors, thermoionic tube, radioispotic switches, electro-mechanical switches, polarized light switches, light phase switches, superconductor switches, or charge bubbles. With switches 41*a*, 41*b*, and 41*c*, active sampler antenna 10 provides a direct conversion from a DC power generated by a power source 42, such as a battery, to an RF excitation of conducting plates 12*a*, 12*b*, and 12*c*. Battery 42 has two terminals. The first terminal of power source 42 is connected to conducting plates 21*a*, 21*b*, and 21*c*. The second terminal of power source 42 is connected to switches 41*a*, 41*b*, and 41*c*, which are also connected to conducting plates 12*a*, 12*b*, and 12*c*, respectively. Conducting plates 12*a*–12*c* and 21*a*–21*c* may be any surface or plates, whether planar or stacked.

Skin currents are induced onto each of conducting plates 12*a*, 12*b*, and 12*c*, which results in scattered or radiated energy in a number of particular directions, each with a particular wave form. The induced charge at each of conducting plates 12*a*, 12*b*, and 12*c* is varied with respect to time and with respect to the assembly. The control of excitation is accomplished by rapidly modulating switches 41*a*, 41*b*, and 41*c*. Specifically, switches 41*a*, 41*b*, and 41*c* are controlled by photodetectors responding to the photonics excitation carried by conductors 43*a*, 43*b*, and 43*c*, respectively. Conductors 43*a*, 43*b*, and 43*c* may be electrical conductors, optical conductors, or optical waveguides. The modulated light is conducted via conductors 43*a*, 43*b*, and 43*c* into switches 41*a*, 41*b*, and 41*c*. The charges are then coupled to conducting plates 12*a*, 12*b*, and 12*c* in an appropriate polarity and sequence to generate skin currents on the surface of conducting plates 12*a*, 12*b*, and 12*c*, which subsequently radiate RF energy.

Power source 42 available to switches 41*a*, 41*b*, and 41*c* and the physical characteristics of the structure of conducting plates 12*a*, 12*b*, and 12*c* determine the maximum radiated power available from each antenna element. Thus, the voltage choice for power source 42 depends on the desired transmission requirements. As a further refinement for controlling switches 41*a*, 41*b*, and 41*c*, each of switches 41*a*, 41*b*, and 41*c* can be connected in parallel with a respective variable resistor such that the amount of energy deliver to each of switches 41*a*, 41*b*, and 41*c* can be controlled via the associated variable resistor.

As has been described, the present invention provides an improved method and apparatus for transmitting signals via an active sampler antenna. The present invention enables the conducting plates of each antenna element to be controlled by monolithic circuits for directly converting electrical power to RF under photonic control. The light wave carriers modulation is directly synthesized up to the frequency limits of high-speed logic progressing to a system design of all digital receivers and transmitters. The present invention is intended to include active sampler antennae in their various implementation forms encompassing the basic active sampler antenna elements, one-dimensional array, two-dimensional array, three-dimensional array, N(1−D) array segments, 1×N(1−D):N(1−D)×1 depopulated and fully populated linear arrays, and depopulated and fully populated cell subarrays of any orientation. In addition, the active sample antenna of the present invention may be a flexible structure of any orientation that allows conformance of the active sampler antenna to a supporting structure.

While the invention has been particularly shown and described with reference to a preferred embodiment, it will be understood by those skilled in the art that various changes in form and detail may be made therein without departing from the spirit and scope of the invention.

What is claimed is:

1. An active sampler antenna comprising:

a first set of conducting surfaces;

a second set of conducting surfaces located substantially parallel to said first set of conducting surfaces;

a power source having a first terminal and a second terminal, wherein said first terminal is connected to said second set of conducting surfaces; and a plurality of switches, each of said plurality of switches is connected between a respective one of said first set of conducting surfaces and said second terminal of said power source, wherein said plurality of switches allows an amount and timing of charges to be delivered from said power source to said first set of conducting surfaces for generating an energy packet approximating a time-space distribution of current over said first set of conducting surfaces for transmitting or cancelling signals.

2. The active sampler antenna of claim 1, wherein said plurality of switches are photosensitive switches.

3. The active sampler antenna of claim 1, wherein said plurality of switches are semiconductor switches.

4. The active sampler antenna of claim 1, wherein said plurality of switches are transistors.

5. The active sampler antenna of claim 1, wherein said plurality of switches are thermoionic tube.

6. The active sampler antenna of claim 1, wherein said plurality of switches are electro-mechanical switches.

7. The active sampler antenna of claim 1, wherein said plurality of switches are radioisotropic switches.

8. The active sampler antenna of claim 1, wherein said plurality of switches are polarized light switches.

9. The active sampler antenna of claim 1, wherein said plurality of switches are light phase switches.

10. The active sampler antenna of claim 1, wherein said plurality of switches are superconductor switches.

11. The active sampler antenna of claim 1, wherein said plurality of switches are charge bubbles.

12. The active sampler antenna of claim 1, wherein said active sampler antenna further includes a plurality of optical fibers coupled to a respective one of said switches for activating said switches.

13. The active sampler antenna of claim 1, wherein said active sampler antenna further includes a plurality of optical conductors coupled to a respective one of said switches for activating said switches.

14. The active sampler antenna of claim 1, wherein said active sampler antenna further includes a plurality of optical waveguides coupled to a respective one of said switches for activating said switches.

15. The active sampler antenna of claim 1, wherein said active sampler antenna further includes a plurality of electrical conductors coupled to a respective one of said switches for activating said switches.

16. The active sampler antenna of claim 1, wherein said conducting surfaces are planar.

17. The active sampler antenna of claim 1, wherein said conducting surfaces are stacked.

18. The active sampler antenna of claim 1, wherein said conducting surfaces are plates.

19. The active sampler antenna of claim 1, wherein said conducting surfaces are small gap relative to size of surfaces to provide lighting diversion, wherein a difference is one order of magnitude.

20. The active sampler antenna of claim 1, wherein said active sample antenna is a flexible structure of any orientation that allows conformance of said active sampler antenna to a supporting structure.

21. A method for transmitting signals via an active sampler antenna, wherein said active sampler antenna includes a first set of conducting surfaces and a second set of conducting surfaces located substantially parallel to said first set of conducting surfaces, said method comprising:

connecting one of two terminals of a power source to said second set of conducting surfaces;

coupling a plurality of switches between said first set of conducting surfaces and said second set of conducting surfaces, wherein each of said plurality of switches is connected between a respective one of said first set of conducting surfaces and another one of said two terminals of said power source; and generating radiating waves via said first set of conducting surfaces by allowing a controlled amount and timing of charges delivered from said power source to said first set of conducting surfaces for generating an energy packet approximating a time-space distribution of current over said set of conducting surfaces for transmitting or cancelling signals.

22. The method of claim 21, wherein said plurality of switches are photosensitive switches.

23. The method of claim 21, wherein said plurality of switches are semiconductor switches.

24. The method of claim 21, wherein said plurality of switches are electro-mechanical switches.

25. The method of claim 21, wherein said plurality of switches are transistors.

26. The method of claim 21, wherein said method further includes coupling a plurality of optical fibers to a respective one of said switches for activating said switches.

27. The method of claim 21, wherein said method further includes coupling a variable resistor to a respective one of said switches for controlling said respective switch.

* * * * *